US005095601A

United States Patent [19]

Buchegger

[11] Patent Number: 5,095,601

[45] Date of Patent: Mar. 17, 1992

[54] APPARATUS FOR FIXING A ROLL RING ON A ROLL SHAFT

[75] Inventor: Rudolf Buchegger, St. Florian, Austria

[73] Assignee: Voest-Alpine Industrieanlagenbau Gesellschaft m.b.H., Linz, Austria

[21] Appl. No.: 419,309

[22] Filed: Oct. 10, 1989

[30] Foreign Application Priority Data

Oct. 11, 1988 [DE] Fed. Rep. of Germany ..... 3834606

[51] Int. Cl.[5] ..... B60B 9/00; B25G 3/20

[52] U.S. Cl. ..... 29/117; 29/123; 403/371

[58] Field of Search ..... 29/119, 123, 117; 72/199, 237, 238; 403/368, 369, 370, 371

[56] References Cited

U.S. PATENT DOCUMENTS 4,099,311 7/1978 Kark ..... 29/126
4,650,364 3/1987 Kark ..... 403/368
4,841,612 6/1989 Kark ..... 29/123
4,866,969 9/1989 Reismann et al. ..... 72/238

*Primary Examiner*—Joseph M. Gorski
*Assistant Examiner*—S. Thomas Hughes
*Attorney, Agent, or Firm*—Townsend and Townsend

[57] ABSTRACT

In an apparatus for fixing a roll ring 4 on a roll shaft 2 mounted in two parallel roll stands 1*a*, 1*b* on both sides of the roll ring, by means of a tensioning means 18 and an axially tensionable conical sleeve 8 a radial tension is generated in the roll ring 4. In addition, the conical sleeve 8 carries the roll shaft bearing 3*a*.

To enable the axial and radial tensioning of the roll ring 4 to be adjusted simply and accurately in spite of the additional roll shaft bearing 3*a*, the tensioning means 18 acts on the one hand on the conical sleeve 8 via a first thrust transmitting means passing through the roll stand 1*a* and on the other hand on the roll ring 4 clamped between two thrust rings 22, 23 via a second thrust transmitting means passing through the roll stand, one of the two thrust transmitting means also receiving the roll shaft bearing 3*a*.

10 Claims, 2 Drawing Sheets

APPARATUS FOR FIXING A ROLL RING ON A ROLL SHAFT

BACKGROUND OF THE INVENTION

The invention relates to an apparatus for fixing a roll ring on a roll shaft, said roll shaft being rotatably mounted in two roll stands by means of shaft bearings on either side of said roll ring.

In a known apparatus of this type (EP-A2 163 104) with an axially tensionable conical sleeve a radial pretension is to be produced in the roll ring made from hard metal and disposed on the conical roll shaft. The pretensioning force is applied with a nut screwed onto the threaded portion on the shaft stump. This pretension is necessary for centering the roll ring and ensuring adequate force locking for the torque transmission from the roll shaft to the roll ring.

Because of the tension sensitivity of hard metal roll rings, exceeding the admissible roll ring pretension can lead directly to increasing the danger of breakage. However, tensioning within the range of the admissible limit values must be aimed at to ensure reliable rotary entrainment even under shock load.

The known axial adjustment of the conical sleeve with the pretensioning nut does not permit an adequate accuracy of the pretensioning of the roll ring because this conical sleeve bearing over its entire length conically on the roll shaft must also carry and centre a roll shaft bearing and it is thus completely unclear where the tightening moment actually acts.

Furthermore, AT-PS 313,839 discloses an apparatus for fixing a roll ring, although with a flying arrangement of the roll ring, the free end of the roll shaft bearing an end cap with an external thread for receiving a pretensioning nut with the aid of which the roll ring consisting of hard metal and provided with a corresponding roll pass for making profile wires is subjected to an axial compressive pretension between two thrust rings. In addition to this axial compressive pretension a radial pretension is desired, this being done with the aid of a conical sleeve between the roll ring and the roll shaft conical in the region of the roll ring. Said conical sleeve is driven into the annular gap between the roll ring and the conical part of the roll shaft via adjusting screws held screwably adjustable in the end cap and distributed over the periphery. This pretensioning of the roll ring serves firstly to ensure adequate force locking for the torque transmission from the roll shaft to the roll ring and secondly reduces the notch effects and loads occurring in the region of the roll ring in the rolling operation. Since due to the tension sensitivity of the hard metal roll rings exceeding the admissible ring pretensioning leads directly to an increase in the danger of breakage, but nevertheless a pretensioning of the roll rings in the range of the admissible limit value is desired to ensure rotary entraining of the roll rings even under shock load, an exact adjustment of the pretension both in the axial and radial direction is necessary, advantageously independently of each other.

The known axial adjustment of the conical sleeve via adjusting screws held screwably adjustable in the end cap admittedly permits a setting of the radial pretension independent of the axial pretension but this setting is complicated because the individual adjusting screws must be tightened with a torque key. In addition, this construction does not provide any indication how in a mounting of the roll shaft on both sides of the roll ring the thrust transmitting means would have to be formed to achieve satisfactory mounting of the roll shaft in the roll stand and satisfactory pretensioning of the roll ring.

SUMMARY OF THE INVENTION

The object of the invention is therefore to avoid these defects and improve an apparatus of the type outlined at the beginning in such a manner that the roll ring, both in axial and in radial direction, with mounting of the roll shaft disposed on both sides of the roll ring in the roll stands, can be simply and accurately pretensioned without complicated manual work and the replaceability of the roll ring is not impaired.

The apparatus according to the invention which achieves this object comprises a radially expandable conical sleeve located radially between the roll ring and a conical portion of the roll shaft, a tensioning device mounted on the roll shaft at the side of one of said roll stands remote from said roll ring, for generating an axially directed tensioning force, first thrust transmitting means extending through said one roll stand for transmitting said axial tensioning force onto the conical sleeve for expanding the sleeve, thereby radially clamping the roll ring onto the roll shaft, and second thrust transmitting means extending through said one roll stand for transmitting said axial tensioning force onto a thrust ring to axially clamp the roll ring between the thrust ring and a shoulder of the roll shaft.

In a preferred embodiment, said first thrust transmitting means comprises a centering sleeve arranged between the roll shaft bearing and the roll shaft conical in the region of the roll shaft bearing and the centering sleeve and the conical sleeve are connected by a spring element, this making it possible to separate the function of the bearing centering and the function of the centering and bracing of the roll ring.

To enable the bracing of the roll ring to be released simply the spring element comprises on both ends annular projections which form a hooking connection with annular projections on the centering sleeve and on the conical sleeve.

If the radial pretension is to be less than the axial pretension it is advantageous to arrange between the tensioning means and the centering sleeve a spring pack limiting the tensioning force.

To enable the bracing to be released easily it is provided that the tensioning means consists of a hydraulic piston which can be acted upon on both sides and which cooperates with the two thrust transmitting means.

The construction of the tensioning means with two hydraulic pistons adapted to be acted upon on both sides, each hydraulic piston having associated therewith a thrust transmitting means, firstly ensures an exact and simple pretensioning of the roll ring in the axial and radial direction via the respective acting pressure; this enables not only compensational different thermal expansions but also of thermal stresses occurring during the rolling operation.

To achieve uniform action the hydraulic pistons are formed as annular pistons. A further understanding of the nature and advantages of the invention may be realized by reference to the remaining portions of the specification and the drawings.

DESCRIPTION OF SPECIFIC EMBODIMENTS

Figure 1:
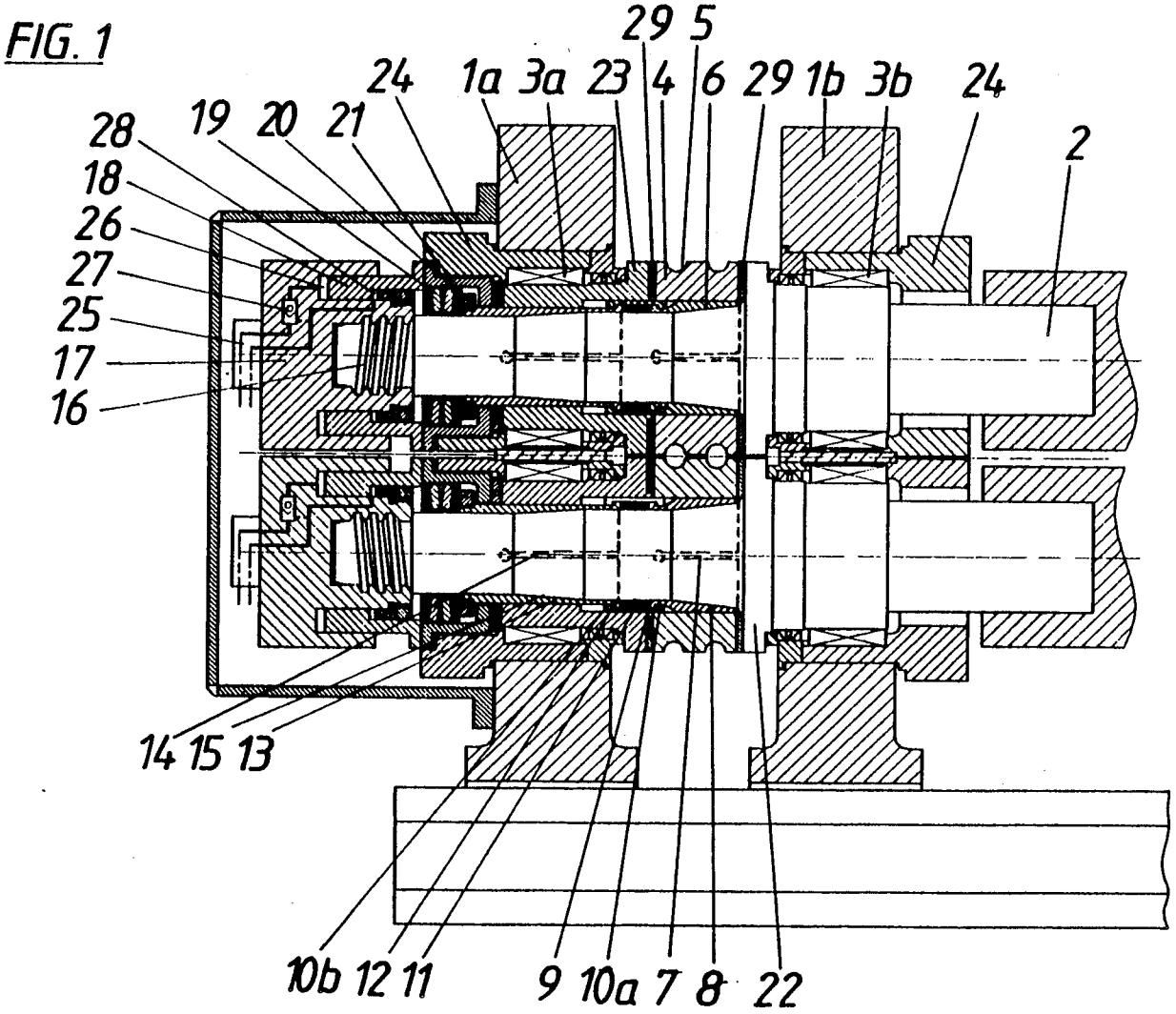
FIG. 1 is an axial section of an apparatus according to the invention for foxing a roll ring on a roll shaft mounted on both sides of the roll ring in roll stands.

The roll shaft 2 mounted in usual manner in roll stands 1*a*, 1*b* carries in the region between the two roll shaft bearings 3*a*, 3*b* a roll ring 4 of hard metal with corresponding roll passes 5 for making profile wires or rod-like profiles. Between said roll ring 4 and the roll shaft 2, which has a conical portion 6 in the region of the roll ring 4, a conical sleeve 8 is arranged which is provided with axial slots 7 serving firstly for centering and secondly for radial pretensioning of the roll ring 4. Said conical sleeve 8 comprises an annular projection 9 which forms a hooking connection with an annular projection 10*a* of a spring element 11. At the opposite end the spring element 11 likewise comprises an annular projection 10*b* which forms a hooking connection with an annular projection 12 of a centering sleeve 13. The conical sleeve 8 is thus coupled in movement with the centering sleeve 13 via the spring element 11. The centering sleeve 13 provided with axial slots 14 and the roll shaft 2 have in the region of the roll shaft bearing 3*a* a conical portion 15 which permits clear centering of the roll shaft bearing 3*a* in the roll stand 1*a*. The end of the roll shaft 2 provided with a thread 16 receives a support 17 for a tensioning means formed as hydraulic piston 18 and acting via a spring pack 19 on the previously described centering sleeve 13. On retracting the hydraulic piston 18 a ring 20 secured to the centering sleeve 13 is brought into engagement with a thrust ring 21 and the first thrust transmitting means consisting of spring pack 19, centering sleeve 13 with ring 20, thrust ring 21 and spring element 11 is retracted.

The axial holding of the roll ring 4 is between a shoulder 22 of the roll shaft and a thrust sleeve 23 which simultaneously serves as seat for the roll shaft bearing 3*a*. The torque transmission from the roll shaft 2 to the roll ring 4 can be improved by friction elements 29 on both sides of the roll ring 4. The axial force is applied by the hydraulic piston 18 which acts on the roll ring 4 via the second thrust transmitting means formed by the thrust ring 21 and the thrust sleeve 23.

In the roll stands 1*a*, 1*b* the roll shaft bearings 3*a*, 3*b* are mounted in eccentric sleeves 24, the spacing of the two cooperating roll rings 4 thus being adjustable.

The pretension is generated with a hydraulic piston 18 which can be acted upon on both sides. The hydraulic medium is supplied with a pump, not illustrated, via a rotary introduction 25 and the support 17 of the pressure chamber 26. To avoid having to keep the pump in operation during the entire use a check valve 27 is provided in the supply conduit and with said valve the pressure in the pressure chamber 26 is maintained. For relieving the hydraulic piston 18 hydraulic medium is supplied via a second conduit to the check valve 27 and relieves the latter. When the conical sleeve 8 is retracted hydraulic medium is supplied to the pressure chamber 28 and the hydraulic piston 18 pushed back.

Figure 2:
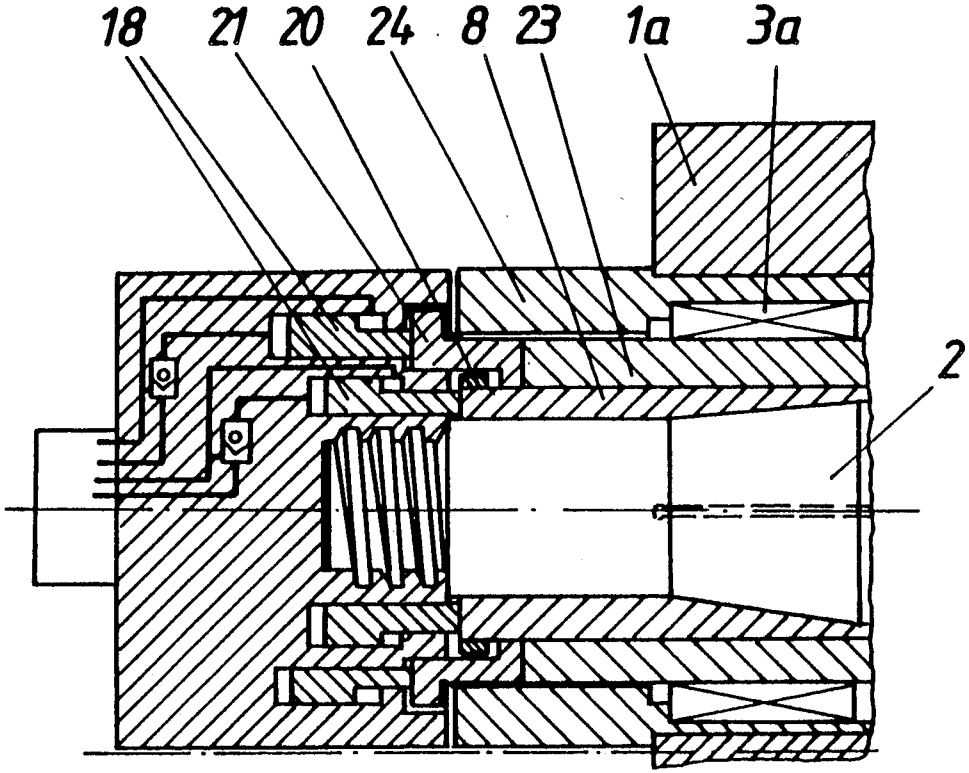
FIG. 2 is an enlarged partial section view of an arrangement in which a separate hydraulic cylinders are associated with each thrust transmitting means.

An improvement in the functions is achieved in that associated with each thrust transmitting means is a separate hydraulic piston; the spring pack 19 can be omitted because it is possible with the two annular pistons to generate different pressures for the axial and radial bracing of the roll rings 4 (FIG. 2).

I claim:

1. Apparatus for fixing a roll ring on a roll shaft rotatably mounted in roll stands by means of shaft bearings on both sides of said roll ring, said apparatus comprising:

radially expandable conical sleeve located radially between the roll ring and a conical portion of the roll shaft;

tensioning means mounted on the roll shaft at the side of one of said roll stands remote from said roll ring, for generating an axially directed tensioning force;

first and second thrust transmitting means both extending through said one roll stand for substantially simultaneously transmitting said axially tensioning force, said first thrust transmitting means transmitting said force onto the conical sleeve for expanding the sleeve, thereby radially clamping the roll ring onto the roll shaft; and said second thrust transmitting means transmitting said axially tensioning force onto a thrust ring to axially clamp the roll ring between the thrust ring and a shoulder of the roll shaft.

2. The apparatus according to claim 1, wherein one of said first and second thrust transmitting means includes a bearing sleeve mounting the shaft bearings in said one roll stand.

3. The apparatus as claimed in claim 1, wherein said second thrust transmitting means includes a sleeve extending through said one roll stand and having said thrust ring integrally formed thereon.

4. The apparatus as claimed in claim 1, wherein said first thrust transmitting means includes a centering sleeve located radially between the shaft bearing and a conical portion of the shaft, said centering sleeve being axially interposed between said tensioning means and said expandable conical sleeve.

5. The apparatus as claimed in claim 4, wherein said centering sleeve is connected to said expandable conical sleeve by spring means.

6. The apparatus as claimed in claim 5, wherein the spring means has annular engaging means at both ends thereof for forming a hooking connection with corresponding annular projections of said centering sleeve and said expandable conical sleeve.

7. The apparatus as claimed in claim 1, wherein a spring pack is interposed between said tensioning means and said first thrust transmitting means for limiting the tensioning force.

8. The apparatus as claimed in claim 7, wherein said tensioning means comprises a double-acting hydraulic piston acting on both said spring pack and second thrust transmitting means.

9. The apparatus as claimed in claim 1, wherein said tensioning means comprises two double-acting hydraulic pistons acting on one of said first and second thrust transmitting means, respectively.

10. The apparatus as claimed in claim 8, wherein each of said hydraulic pistons comprises an annular hydraulic piston.

* * * * *